US006942078B2

(12) United States Patent
Hamm et al.

(10) Patent No.: US 6,942,078 B2
(45) Date of Patent: Sep. 13, 2005

(54) CABLE REEL

(75) Inventors: Silvio Hamm, Sülzfeld (DE); Heinrich Komesker, Unkel (DE); Manfred Prell, Burglauer (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 62 days.

(21) Appl. No.: 10/791,594

(22) Filed: Mar. 1, 2004

(65) Prior Publication Data

US 2004/0168872 A1 Sep. 2, 2004

Related U.S. Application Data

(63) Continuation of application No. PCT/EP02/09514, filed on Aug. 26, 2002.

(30) Foreign Application Priority Data

Aug. 30, 2001 (DE) ..... 101 42 110

(51) Int. Cl.[7] ..... H02G 11/02

(52) U.S. Cl. ..... 191/12.2 R; 191/12 R; 242/376.1; 242/381.5

(58) Field of Search ..... 191/12.2 R, 12.4, 191/12 R, 12.2 A; 242/376.1, 379, 381, 381.5, 381.6, 396.6, 396.8

(56) References Cited

U.S. PATENT DOCUMENTS

| | | | | | |
|---|---|---|---|---|---|
| 4,437,624 | A | * | 3/1984 | Rosenberg | 242/381 |
| 4,483,330 | A | * | 11/1984 | Jacobsen et al. | 602/32 |
| 4,565,011 | A | * | 1/1986 | Karger | 33/414 |
| 4,588,226 | A | * | 5/1986 | Young et al. | 297/344.24 |
| 4,830,308 | A | * | 5/1989 | Puryear | 242/288 |
| 5,064,139 | A | * | 11/1991 | Toda | 242/295 |
| 5,701,981 | A | * | 12/1997 | Marshall et al. | 191/12.4 |
| 6,179,104 | B1 | | 1/2001 | Steinmüller et al. | |
| 6,349,808 | B1 | * | 2/2002 | Bryant | 191/12.2 R |

FOREIGN PATENT DOCUMENTS

| | | | | |
|---|---|---|---|---|
| DE | 31 15 740 | A1 | 11/1982 | |
| DE | 38 13 824 | A1 | 11/1989 | |
| DE | 3813824 | A1 * | 11/1989 | A47L/9/26 |
| DE | 195 05 926 | A1 | 8/1996 | |
| JP | 10297836 | A | 11/1998 | |
| JP | 2002095233 | A | 3/2002 | |

* cited by examiner

*Primary Examiner*—Frantz F. Jules
(74) *Attorney, Agent, or Firm*—John T. Winburn; Russell W. Warnock; Craig J. Loest

(57) ABSTRACT

A cable reel makes possible a diversion of a braking pulse onto a housing by using elastic elements that mount the cable reel inside the housing, whereby the braking energy is converted into heat. The cable reel is, in particular, also suited for reel bodies that hold long cable lengths. In particular, the cable reel is used in a vacuum cleaner.

14 Claims, 7 Drawing Sheets

CABLE REEL

CROSS-REFERENCE TO RELATED APPLICATION

This application is a continuation, under 35 U.S.C. § 120, of copending international application No. PCT/EP02/09514, filed Aug. 26, 2002, which designated the United States; this application also claims the priority, under 35 U.S.C. § 119, of German patent application No. 101 42 110.9, filed Aug. 30, 2001; the prior applications are herewith incorporated by reference in their entirety.

BACKGROUND OF THE INVENTION

Field of the Invention

The invention relates to a cable reel, especially for a vacuum cleaner, including a reel body and a base plate against which the reel body is rotatably mounted, and a braking coulisse.

German Published, Non-Prosecuted Patent Application DE 195 05 926 A1 discloses a cable drum including a drum body having two flanges and a drum core, rotatably mounted on a supporting structure and an apparatus for automatically winding a multi-core network cable on the drum body. The supporting structure has a bearing journal that extends through the supporting structure and a spiral winding spring is clamped between the supporting structure and the drum body.

Such cable reels are primarily used in mobile electrical appliances such as vacuum cleaners, heaters, power tools, and the like. They facilitate usage of the appliance because only as much cable as is required for handling the appliance comes out of the appliance.

If during winding of the cable onto the cable reel, braking is applied by the braking coulisse, there is a need to brake this efficiently, especially if a long length of cable is wound onto the cable reel.

SUMMARY OF THE INVENTION

It is accordingly an object of the invention to provide a cable reel that overcomes the hereinafore-mentioned disadvantages of the heretofore-known devices of this general type and provides a configuration by which the cable reel is effectively braked.

With the foregoing and other objects in view, there is provided, in accordance with the invention, a cable reel, including a base plate, a reel body rotatably mounted with respect to the base plate, a braking coulisse moveable in a radial direction with respect to the base plate, and elastic elements for mounting at least one of the base plate and the reel body in a receiving body.

In accordance with another feature of the invention, the braking coulisse is moveable in the radial direction with respect to the base plate and elastic elements are provided by which the cable reel can be mounted in a receiving body, especially, in a vacuum cleaner.

In accordance with a further feature of the invention, the braking pulse is intercepted by the elastic elements and not passed onto the housing. The entire kinetic energy of the rotating reel body and of the cable taken up by the body is thereby taken up, on one hand, by the movement of the braking coulisse and, on the other hand, by the elastic elements.

In accordance with an added feature of the invention, the invention also relates to a cable reel in which the elastic elements are disposed between the braking coulisse and the body.

In accordance with an additional feature of the invention, the elastic elements are disposed between the base plate and the body.

In accordance with yet another feature of the invention, the cable reel as a whole is mounted in the body using elastic elements.

With the objects of the invention in view, in a vacuum cleaner having a housing part, a there is also provided a cable reel, including a base plate defining an axis, a reel body rotatably mounted to the base plate about the axis, a braking coulisse operatively connected to the reel body for braking rotation of the reel body about the base plate, the braking coulisse moving in a radial direction with respect to the axis of the base plate to brake the reel body, and elastic elements connected to at least one of the base plate and the reel body and mounting the at least one of the base plate and the reel body in the housing part of the vacuum cleaner.

With the objects of the invention in view, there is also provided a cable reel, including a base plate defining an axis, a reel body rotatably mounted to the base plate about the axis, a braking coulisse operatively connected to the reel body for braking rotation of the reel body about the base plate, the braking coulisse moving in a radial direction with respect to the axis of the base plate to brake the reel body, and elastic elements connected to at least one of the base plate and the reel body for mounting the at least one of the base plate and the reel body in a receiving body.

Other features that are considered as characteristic for the invention are set forth in the appended claims.

Although the invention is illustrated and described herein as embodied in a cable reel, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
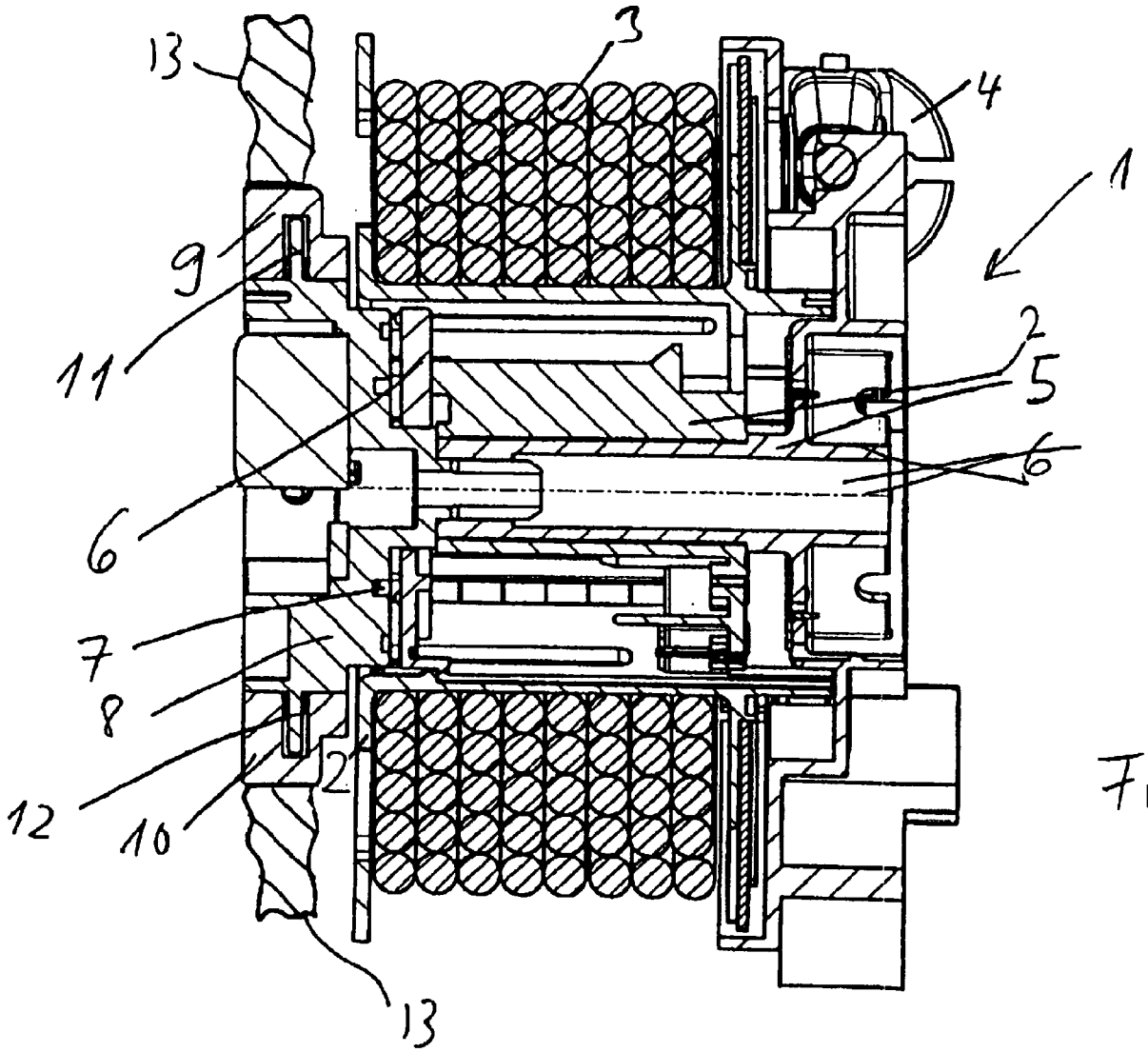
FIG. 1 is a fragmentary cross-sectional view of a cable reel according to the invention.
Figure 2:
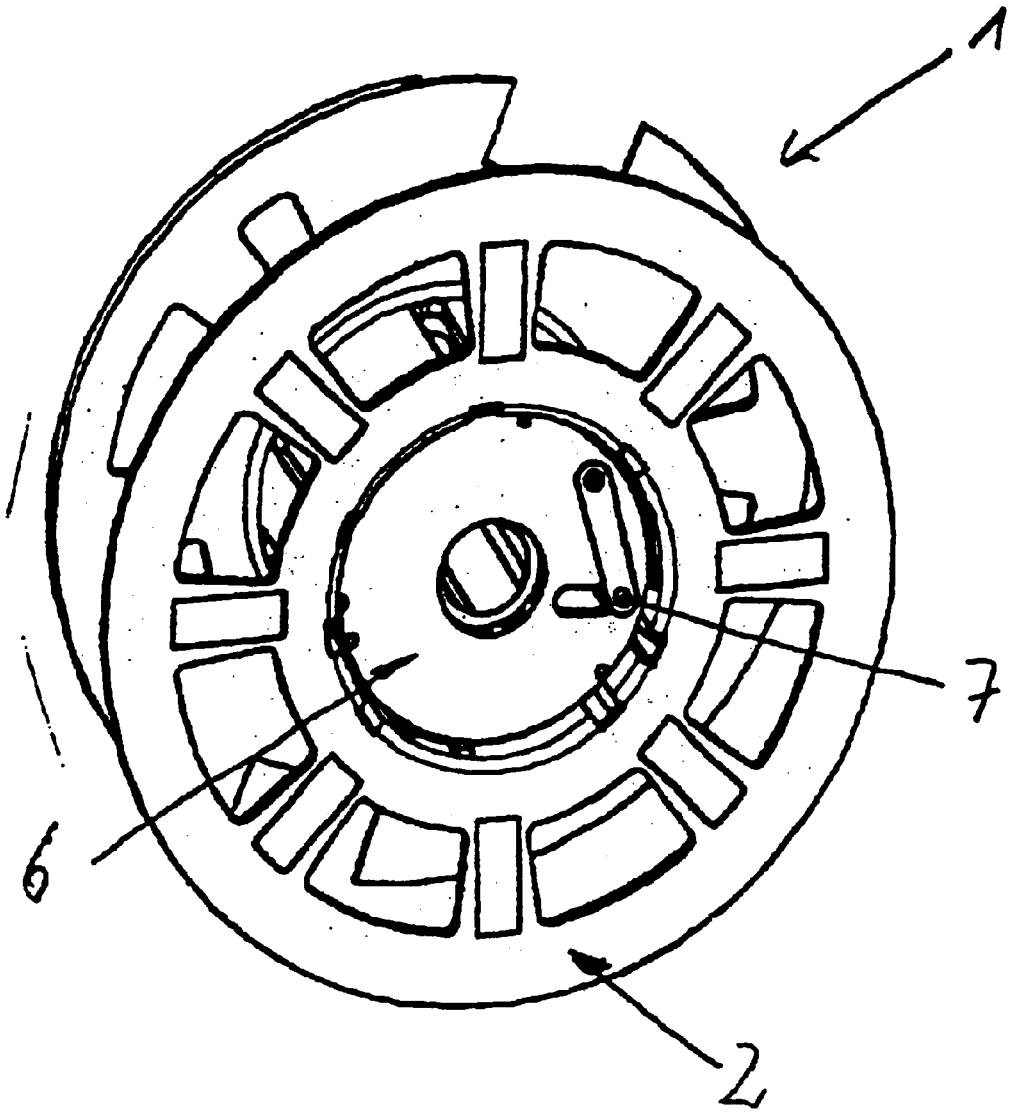
FIG. 2 is a perspective view of the cable drum of FIG. 1.
Figure 3:
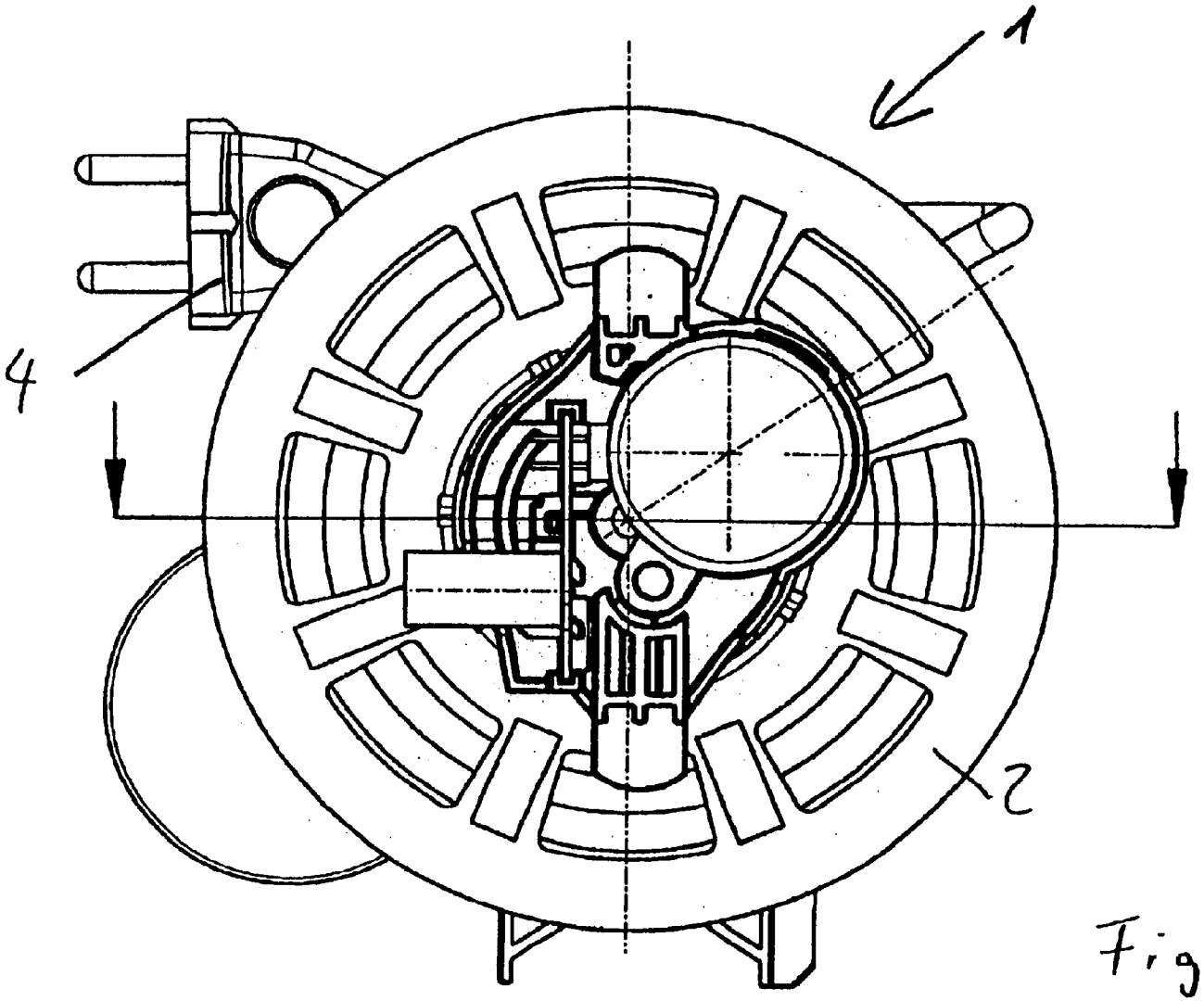
FIG. 3 is a side plan view of the cable reel of FIG. 1.
Figure 4:
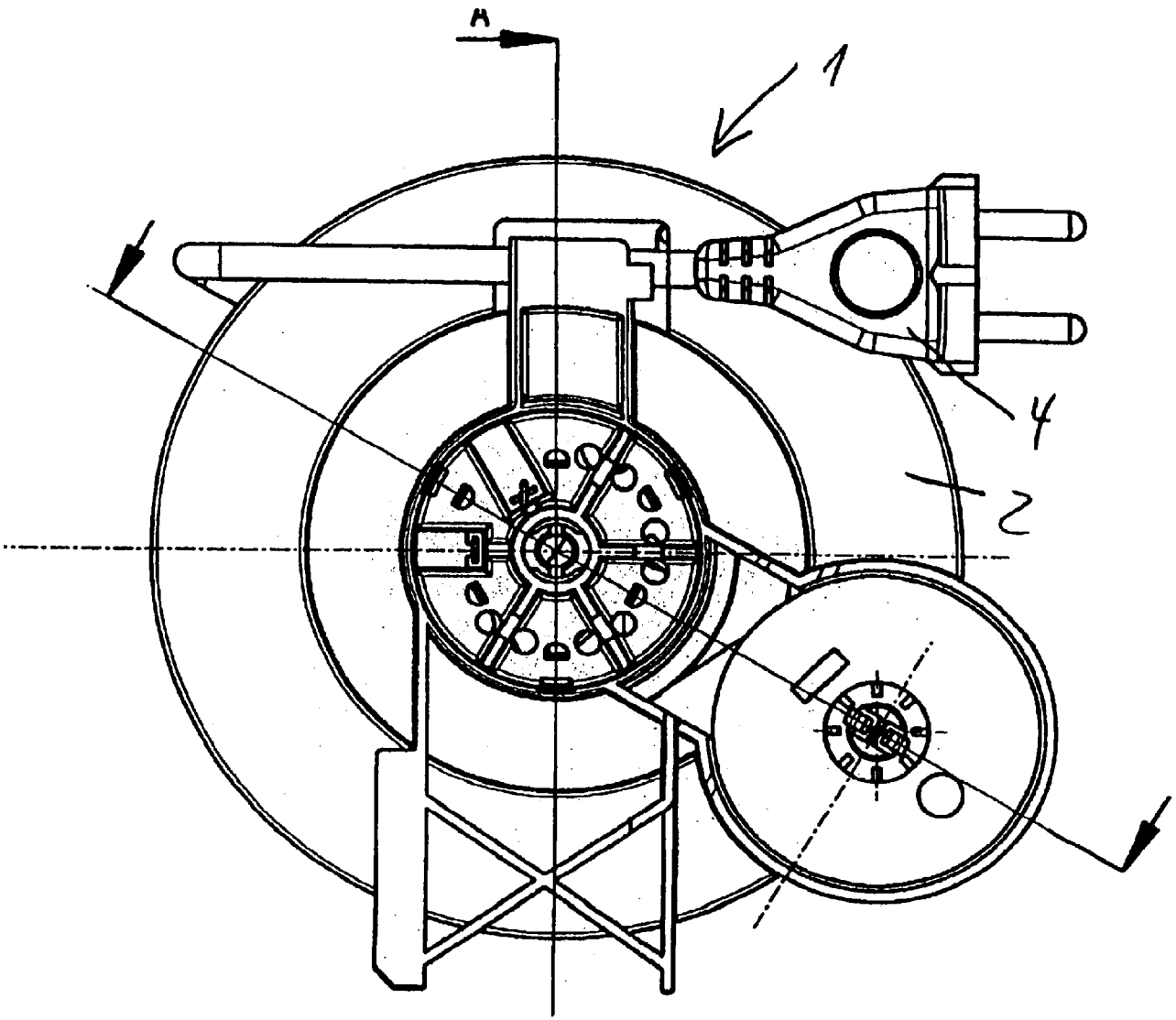
FIG. 4 is a side plan view of the cable reel of FIG. 1.

Referring now to the figures of the drawings in detail and first, particularly to FIGS. 1 to 4 thereof, there is shown a cable reel 1 having a reel body 2 to hold a cable 3 which is wound onto the reel body 2 in many layers and has a plug 4 attached at its outlet end. The reel body 2 is mounted over a base plate 5, which forms its axis of rotation, and rotates about the same.

A retaining plate 6 is fixedly connected to the reel body 2. Attached to the retaining plate 6 is a braking pin 7 (see FIG. 2), which brakes the reel body 2 as a result of a sliding friction exerted by the pin 7 in a braking coulisse 8 and the reel body 2 transfers a braking pulse to the braking coulisse 8 as a result of its rotating movement. The braking coulisse 8 is mounted using elastic elements 9, 10 in a body 13 that holds the cable reel, for example, a vacuum cleaner housing.

The braking coulisse 8, preferably, has outward-pointing projections 11, 12 onto which the elements 9, 10 are pushed.

The base plate 5 is coupled to the braking coulisse 8 such that, on one hand, the braking pulse of the braking coulisse 8 can be transferred to the elastic elements 9, 10 and, on the other hand, however, a fixed connection between the base plate 5 and the braking coulisse 8 is ensured in the axial direction.

Figure 5:
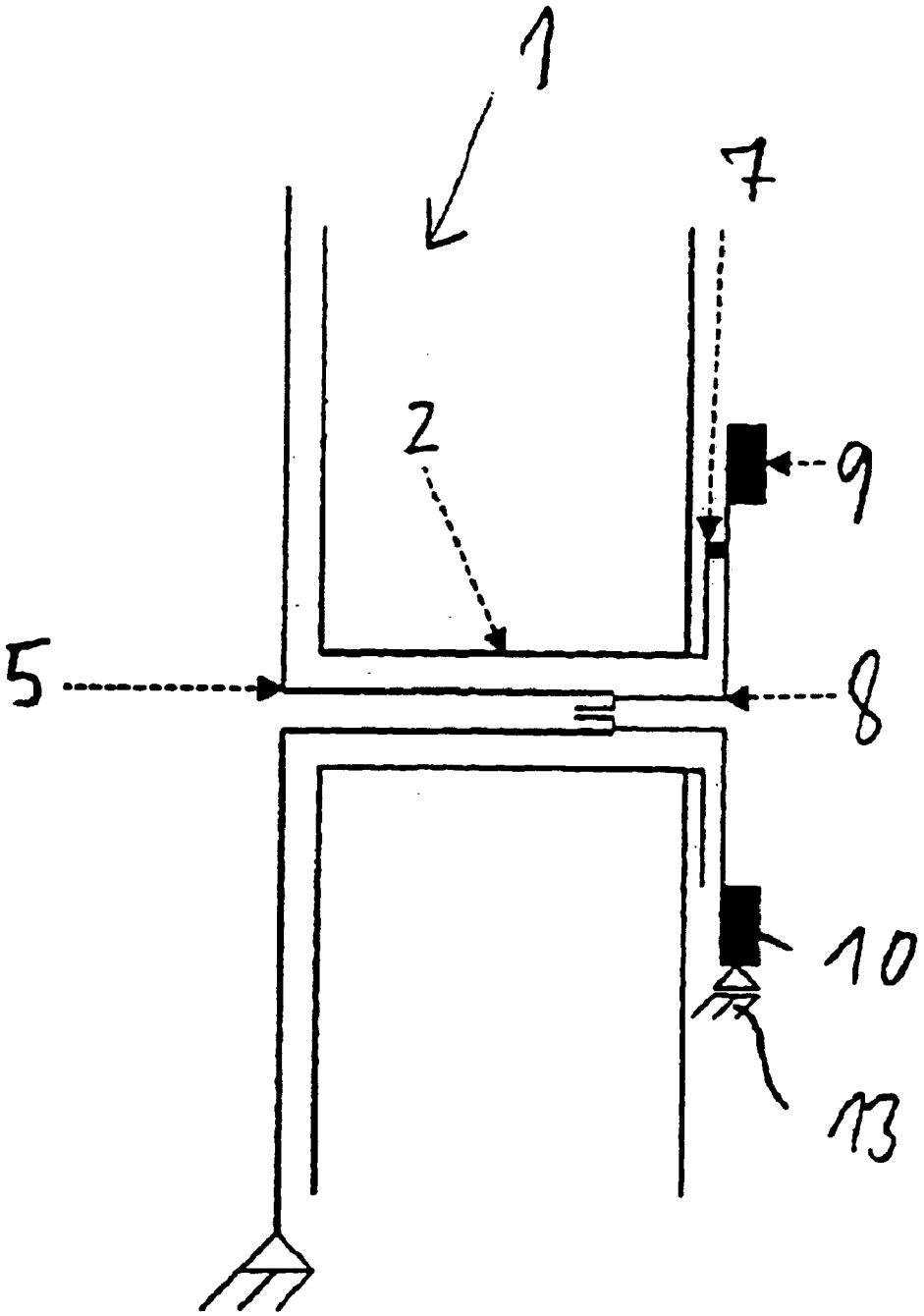
FIG. 5 is a diagrammatic cross-sectional view of a cable reel according to the invention.

In another exemplary embodiment illustrated in FIG. 5, the mounting of the braking coulisse 8 using the elements 9, 10 in a housing 13 is shown schematically.

Figure 6:
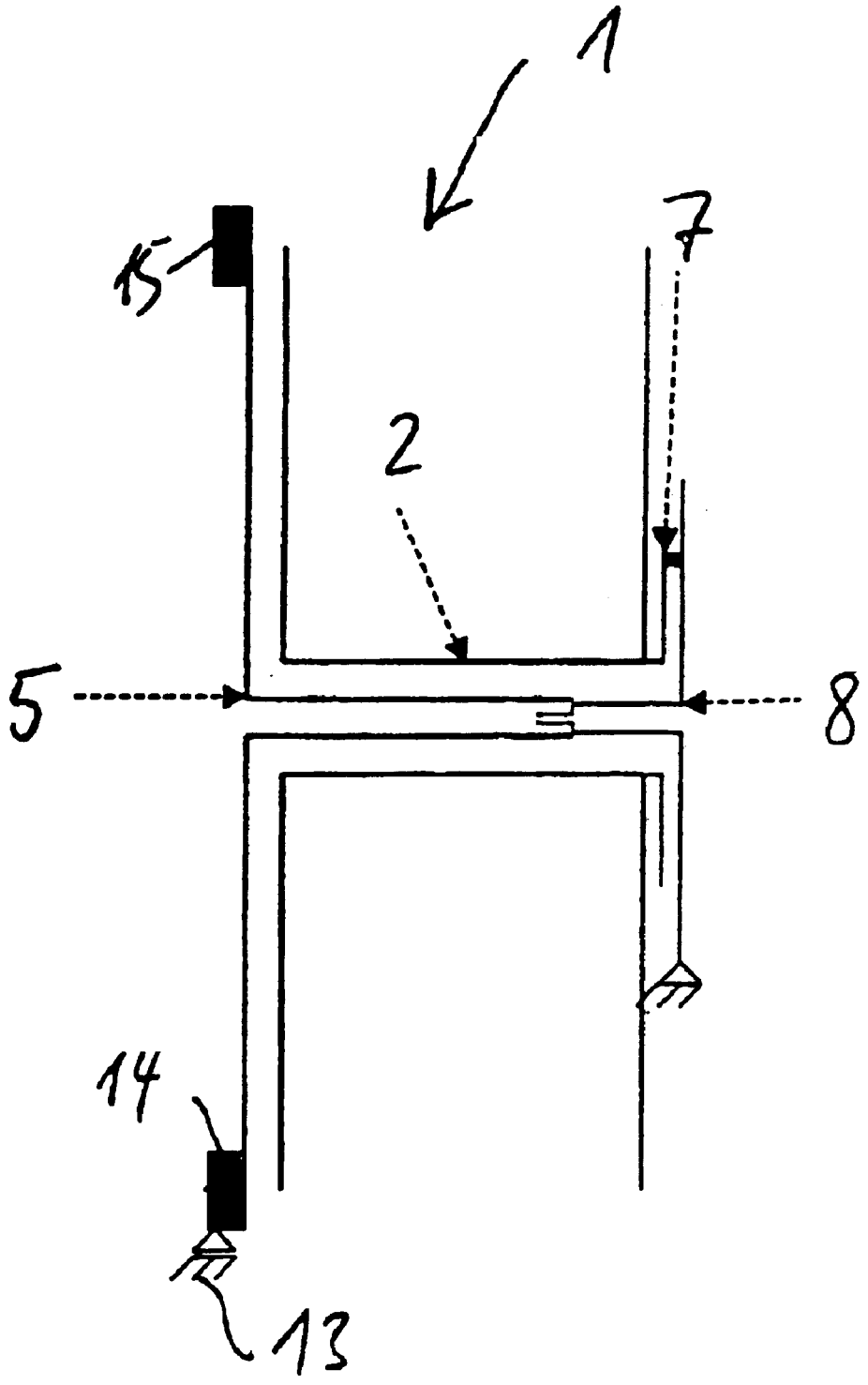
FIG. 6 is a diagrammatic cross-sectional view of a cable reel according to the invention.

In another exemplary embodiment illustrated in FIG. 6, instead of using the elements 9, 10, elastic elements 14, 15 connected to the base plate 5 are provided, which mounts the base plate 5 elastically in the housing 13 and, thereby, facilitates dissipation of the braking pulse.

Figure 7:
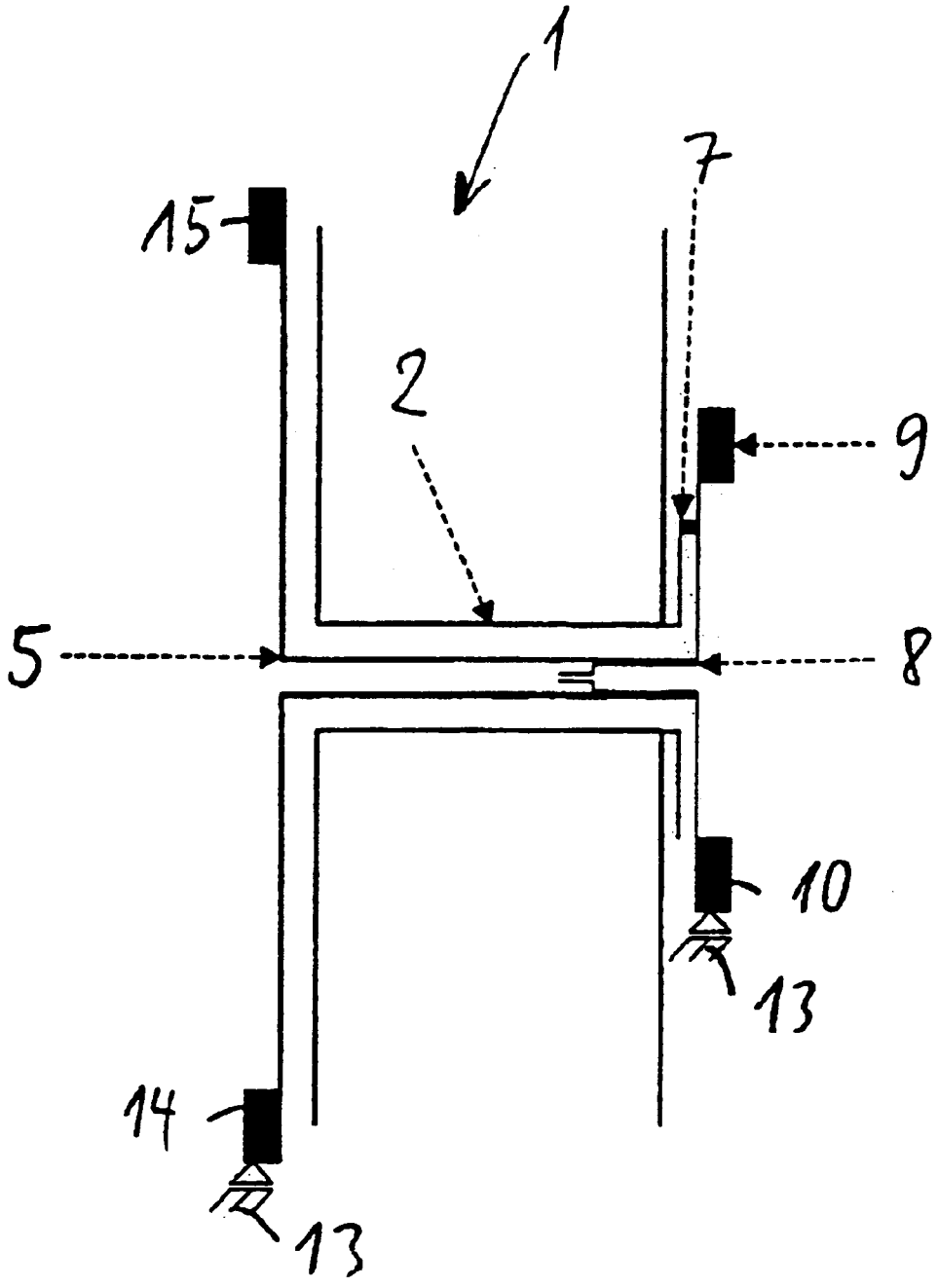
FIG. 7 is a diagrammatic cross-sectional view of a cable reel according to the invention.

In another exemplary embodiment illustrated in FIG. 7, both the elements 9, 10 and the elements 14, 15 are provided to mount the cable reel 1 elastically in the housing 13.

According to the invention, there is provided a cable reel 1 that makes it possible to divert the braking pulse onto the housing 13 by using elastic elements 9, 10; 14, 15 for mounting the cable reel 1 in a housing 13 so that the braking energy is converted into heat. The cable reel 1 according to the invention is especially suited for reel bodies 2 that hold long cable lengths.

We claim:

1. A cable reel, comprising:

a base plate;

a reel body rotatably mounted with respect to said base plate;

a braking coulisse moveable in a radial direction with respect to said base plate; and elastic elements for mounting at least one of said base plate and said braking coulisse in a receiving body.

2. The cable reel according to claim 1, wherein said elastic elements are disposed between said braking coulisse and said receiving body.

3. The cable reel according to claim 1, wherein said elastic elements are disposed between said base plate and said receiving body.

4. The cable reel according to claim 1, wherein said cable reel is mounted in said receiving body as a whole by said elastic elements.

5. The cable reel according to claim 1, wherein said receiving body is a vacuum cleaner.

6. A vacuum cleaner cable reel, comprising:

a base plate;

a reel body rotatably mounted with respect to said base plate;

a braking coulisse moveable in a radial direction with respect to said base plate; and elastic elements for mounting at least one of said base plate and said braking coulisse in a vacuum cleaner.

7. The cable reel according to claim 6, wherein said elastic elements are disposed between said braking coulisse and said vacuum cleaner.

8. The cable reel according to claim 6, wherein said elastic elements are disposed between said base plate and said vacuum cleaner.

9. The cable reel according to claim 6, wherein said cable reel is mounted in said vacuum cleaner as a whole by said elastic elements.

10. In a vacuum cleaner having a housing part, a cable reel, comprising:

a base plate defining an axis;

a reel body rotatably mounted to said base plate about said axis;

a braking coulisse operatively connected to said reel body for braking rotation of said reel body about said base plate, said braking coulisse moving in a radial direction with respect to said axis of said base plate to brake said reel body; and elastic elements connected to at least one of said base plate and said braking coulisse and mounting said at least one of said base plate and said braking coulisse in the housing part of the vacuum cleaner.

11. The cable reel according to claim 10, wherein said elastic elements are disposed between said braking coulisse and said vacuum cleaner.

12. The cable reel according to claim 10, wherein said elastic elements are disposed between said base plate and said vacuum cleaner.

13. The cable reel according to claim 10, wherein said cable reel is mounted in said vacuum cleaner as a whole by said elastic elements.

14. A cable reel, comprising:

a base plate defining an axis;

a reel body rotatably mounted to said base plate about said axis;

a braking coulisse operatively connected to said reel body for braking rotation of said reel body about said base plate, said braking coulisse moving in a radial direction with respect to said axis of said base plate to brake said reel body; and elastic elements connected to at least one of said base plate and said braking coulisse for mounting said at least one of said base plate and said braking coulisse in a receiving body.

* * * * *